US008277148B2

(12) United States Patent
Fox

(10) Patent No.: US 8,277,148 B2
(45) **Date of Patent: *Oct. 2, 2012**

(54) RE-TENSIONABLE CABLE BOLT APPARATUS AND RELATED METHOD

(75) Inventor: William G. Fox, White Plains, KY (US)

(73) Assignee: Rhino Technologies LLC, Lexington, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/035,292

(22) Filed: Feb. 25, 2011

(65) Prior Publication Data

US 2011/0142549 A1 Jun. 16, 2011

Related U.S. Application Data

(63) Continuation of application No. 11/292,489, filed on Dec. 2, 2005, now Pat. No. 7,896,581, and a continuation of application No. PCT/US2008/077726, filed on Sep. 28, 2008.

(51) Int. Cl.
*E21D 20/00* (2006.01)
*E21D 21/00* (2006.01)

(52) U.S. Cl. ..... 405/259.5; 405/259.1; 405/302.2; 299/11; 411/82

(58) Field of Classification Search ..... 405/259.1, 405/259.5, 259.6, 302.2; 299/11, 12; 411/82, 411/82.3

See application file for complete search history.

(56) References Cited

U.S. PATENT DOCUMENTS 5,586,839 A * 12/1996 Gillespie ..... 405/259.1
5,954,455 A * 9/1999 Eaton et al. ..... 405/259.6

* cited by examiner

*Primary Examiner* — John Kreck
*Assistant Examiner* — Sean Andrish
(74) *Attorney, Agent, or Firm* — King & Schickli, PLLC

(57) ABSTRACT

A re-tensionable cable bolt and related methods are provided. In one aspect of the invention, the bolt includes a sleeve for connecting or securing to a cable. The sleeve includes a lower end having a bore adapted for receiving a threaded shank for associating with a tension nut. A plurality of facets along a peripheral portion of the sleeve create corners that prevent the cable from rotating within the borehole during installation. The sleeve may be secured to the cable using resin, which forms another aspect of the invention.

20 Claims, 6 Drawing Sheets

RE-TENSIONABLE CABLE BOLT APPARATUS AND RELATED METHOD

This is a continuation of Ser. No. 11/292,489, filed on Dec. 2, 2005, now U.S. Pat. No. 7,896,581, the disclosure of which is incorporated herein by reference. This is a continuation of international application no. PCT/US08/077726, filed Sep. 28, 2008, the disclosure of which is incorporated herein by reference.

TECHNICAL FIELD

The following technology relates generally to supporting a face of a passage in a geological structure and, more particularly, to a re-tensionable cable bolt apparatus and related methods.

BACKGROUND OF THE INVENTION

In recent decades, numerous proposals have been made for providing in situ support for the face of a passage in a geological structure, such as the roof in an underground mine. A typical arrangement employs an anchor, such as an elongated roof "bolt," that extends into a borehole formed in the face and is grouted in place. Federal regulations pertaining to underground mine safety require the placement of these bolts at frequent intervals throughout the mine passage. Consequently, ease of manufacture and use, as well as reliability, are important considerations in terms of reducing the overall installation cost to the mine owner (which, of course, directly correlates to the profitability of the mining operation).

Currently, a popular approach for roof support is the so-called "cable bolt." This type of bolt comprises a length of flexible metal cable inserted into the borehole and grouted in place, and may be either "passive" or tensionable. In one tensionable version, the bolt includes an externally threaded tension head including opposed, longitudinally extending anti-rotation keys for engaging the sidewalls so as to prevent rotation (see, e.g., U.S. Pat. No. 3,077,809 to Harding et al.). To tension the bolt, an associated nut is advanced against an engagement structure, such as a plate, which serves to support the corresponding face in the desired fashion.

Despite the popularity of the basic tensionable approach over the years, several basic limitations remain. For one, the strata adjacent the mine passage settle or shift over time, which may cause a change in the tension originally applied during the initial installation. Likewise, the bolt over time may experience a loss in tension due to factors such as relaxation or creep. Nevertheless, most existing approaches cannot undergo re-tensioning in any reliable fashion after the initial installation.

Additionally, the current approach for installing passive cable bolts can lead to undesirable "false" tensioning and deleterious "kick back." Specifically, the cable may continue to twist within the borehole upon the application of torque. This can lead the installer to believe that the applied torque tensions the cable bolt, when in fact it is simply causing it to twist (and thus the moniker, "false" tensioning). In some circumstances, this twisting can even cause the bolt to counter-rotate, or "kick back," upon release of the accumulated energy, which is undesirable for obvious reasons.

Accordingly, a need exists for an improved bolting apparatus that overcomes the foregoing limitations of the prior art. Specifically, the bolt should be easy and inexpensive to manufacture and install, without the need for bulky castings that would extend below the roof line. The bolt would be also be tensionable to compress and provide secure, reliable support for the adjacent strata once installed, as well as re-tensionable at a later time should the need arise.

SUMMARY OF THE INVENTION

In accordance with a first aspect of the invention, an apparatus for installation in a borehole formed in a face of a mine passage in association with a cable is disclosed. The apparatus comprises an elongated sleeve for securing to the cable and having a lower end with a bore adapted for receiving a threaded shank. A plurality of facets along a peripheral portion of the lower end of the sleeve form corners adapted for engaging a stratum adjacent the borehole during installation.

In one embodiment, the bore extends through the sleeve and includes an undersized portion for engaging an oversized portion of the cable. Preferably, resin is provided within the bore for connecting the cable to the sleeve. The resin may encompass the oversized portion, and may be injected through a transverse channel in the sleeve communicating with the bore.

In another, more specific embodiment, the plurality of facets are arranged to provide the peripheral portion with a cross section forming a regular polygon (and most preferably a hexagon, with six corners for engaging the stratum). Moreover, at least two of the corners are spaced apart a distance greater than a diameter of the borehole. The corners thus resist rotation of the sleeve within the borehole.

In accordance with a further aspect of the invention, an apparatus for installation in a borehole having a diameter formed in a face of a mine passage is disclosed. The apparatus comprises an elongated cable for extending into the borehole, said cable having an oversized portion. A sleeve includes a bore for receiving the oversized portion of the cable and resin for securing the cable to the sleeve.

In one embodiment, a peripheral portion of the sleeve includes a plurality of facets. Preferably, the facets provide the peripheral portion of the sleeve with a cross-section forming a regular polygon. Most preferably, the cross section is in the form of a hexagon. In a more specific embodiment, the bore includes an internally threaded portion for receiving a threaded shank carrying a tension nut, and the resin holds the oversized portion of the cable within the bore.

In accordance with still another aspect of the invention, a method of forming a bolting apparatus for insertion in a borehole formed in a mine passage is disclosed. The method comprises inserting an oversized portion of a cable into a bore of a sleeve and using resin to secure the oversized portion of the cable within the sleeve. As a result, the resin securely holds the oversized portion of the cable within the sleeve during tensioning.

The method may further include the step of snugging the oversized portion of the cable against an undersized portion of the bore. The securing step may comprise injecting a two-component resin into the bore adjacent the oversized portion of the cable. The method may further include the step of inserting a threaded shank into the sleeve.

In accordance with still a further aspect of the invention, a method of installing a cable bolt in a borehole formed in a mine passage is disclosed. The method comprises securing a cable to a sleeve having an oversized portion relative to the borehole, and securing the cable and sleeve within the borehole. The method further comprises inserting a threaded shank into an internal bore formed in the sleeve.

The method may further include the step of tensioning the bolt by advancing a tension nut along the threaded shank. The oversized portion of the sleeve may include a plurality of facets creating corners, in which case the securing step includes inserting the oversized portion of the sleeve within the borehole. The securing step may also include providing resin around the cable in the borehole. The securing step may comprise using resin to secure the oversized portion of the cable to the sleeve.

These and other aspects of the present invention will become readily apparent to those skilled in this art from the following description wherein there is shown a preferred embodiment simply by way of illustration of one of the modes best suited to carry out the invention. As it will be realized, the invention is capable of other different embodiments and it several details are capable of modification in various, obvious aspects all without departing from the invention. Accordingly, the drawings and descriptions will be regarded as illustrative in nature and not as restrictive.

BRIEF DESCRIPTION OF THE DRAWING FIGURES

The accompanying drawings incorporated in and forming a part of the specification, illustrate several aspects of the present invention, and together with the description serve to explain certain principles of the invention. In the drawings:

FIG. 1 is a side view of a cable bolt apparatus forming one aspect of the invention;

FIGS. 2*a*, 2*b*, and 2*c* are side cross-sectional, bottom, and top views of a sleeve forming part of the cable bolt apparatus of FIG. 1;

FIG. 3 is a partially cutaway side cross-sectional view of the sleeve-cable interface;

FIG. 3*a* is a cross-sectional view taken along line 3*a*-3*a* of FIG. 3;

FIG. 3*b* is a cross-sectional view taken along line 3*b*-3*b* of FIG. 3;

Figure 5A:
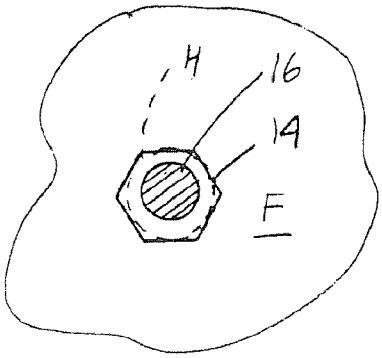
FIG. 5 is a side schematic view similar to FIG. 4, but showing the entire sleeve inserted within the borehole.
Figure 5:
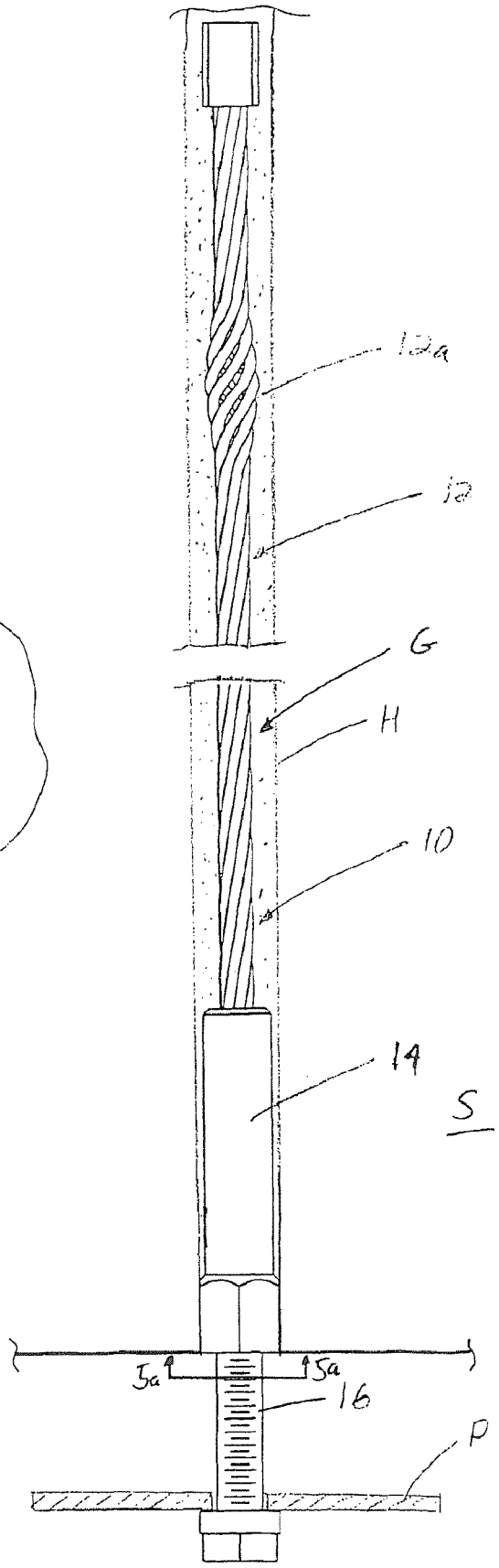
Figure 6:
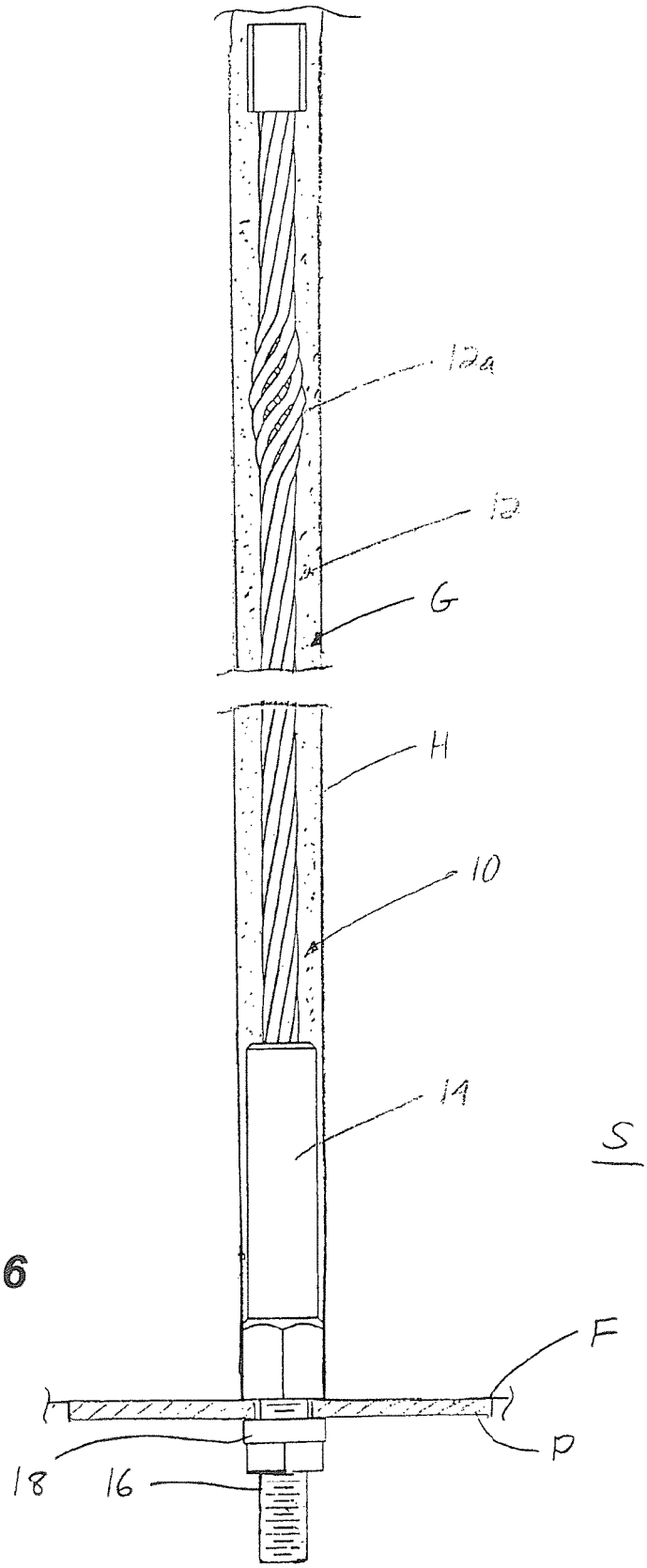

FIG. 5*a* is a partially cross-sectional bottom view taken along line 5*a*-5*a* of FIG. 5; and FIG. 6 is a side schematic view showing the cable bolt apparatus fully installed within the borehole.

Reference is now be made in detail to the preferred embodiments of the invention, an example of which is illustrated in the accompanying drawings.

DETAILED DESCRIPTION OF THE INVENTION

Figure 1:
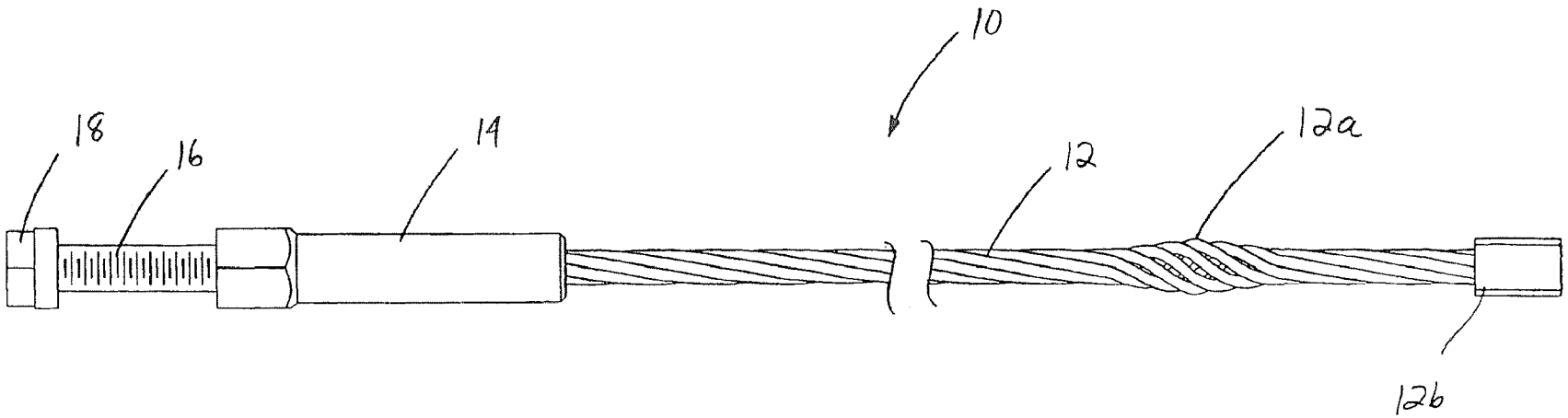

Reference is now made to FIG. 1, which illustrates one embodiment of a tensionable cable bolt apparatus, or bolt 10 for short. The bolt 10 as shown is intended for installation in a face F of a mine passage, such as the roof, having a borehole H formed therein (see FIGS. 4-6). Although the bolt 10 and related installation method are described as being used to reinforce and sustain a mine roof defined by an adjacent stratum S (or strata, as the case may be) in which the borehole H is vertically formed (see FIGS. 4-6), it should be understood that the present invention may be applied to support any one of the other faces of the passage (e.g., a rib) or a different type of geological structure, without limitation.

As illustrated, the bolt 10 is preferably an elongated structure comprising a length of multi-strand, flexible, metal cable 12. The cable 12 is adapted to fit within the borehole H while leaving an annulus A for receiving the resin or grout G used to secure it in place (see FIGS. 4-6). The cable 12 may be of any conventional type, such as that made by spirally wrapping a plurality of wire strands around a center wire.

The cable 12 also includes at least one, and preferably a plurality of enlarged or oversized portions. In the embodiment of FIG. 1, the enlarged or oversized portion is shown as comprising a "bulb" anchor or "bird cage" 12*a* formed in the cable 12, such as in the manner described in U.S. Pat. Nos. 5,344,256, 6,820,657, and International Application Publication No. WO/2005012691 (the disclosures of which are all incorporated herein by reference). However, other techniques for enlarging a portion of the cable 12 may be used instead, including through the use of sleeves for receiving some or all of the strands or the provision of a "nut cage" or the like. The particular manner of enlarging a portion of the cable 12 is considered unimportant to the practice of the invention.

The distal end of the cable 12 may also include a receiver 12*b*. As is known in the art, this receiver 12*b* may be swaged to the cable 12, thus defining wings 12*c*. The receiver 12*b* thus not only serves to receive and hold the ends of the strands forming the cable 12 together, but by virtue of the wings 12*c*, also helps to mix the uncured resin or grout G within the borehole H during installation of the bolt 10.

Figure 2C:
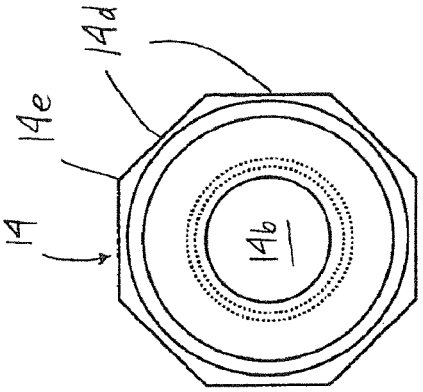
Figure 2B:
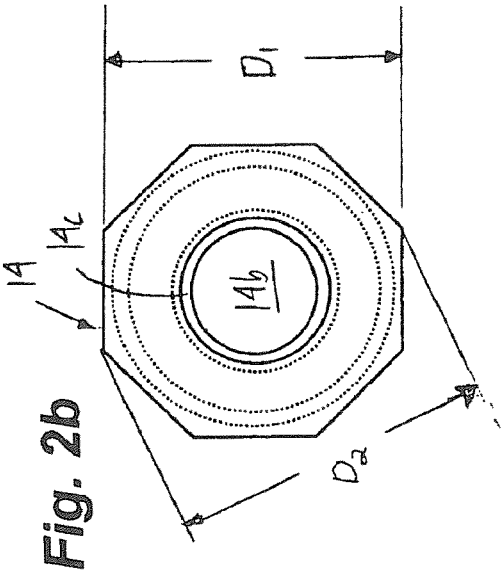
Figure 2A:
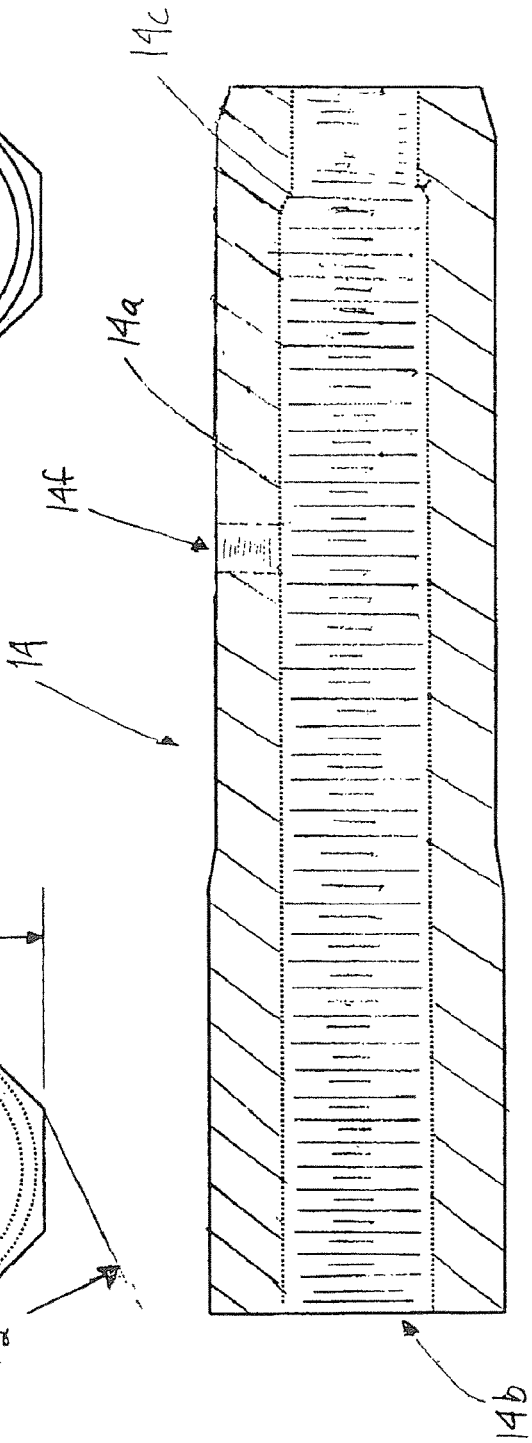

At a first, lower end, the cable 12 is secured to a sleeve 14. Turning now to FIGS. 2*a*-2*c*, one embodiment of the sleeve 14 forming one aspect of the present invention is shown in more detail. Specifically, the sleeve 14 is preferably formed of a single piece of material (such as a metal casting) having an elongated body 14*a* with an internal passage or bore 14*b*. This bore 14*b* is open at both ends of the sleeve 14, and is internally threaded along at least a first, or lower end for receiving the corresponding end of the threaded shank 16. The bore 14*b* also includes an undersized or "necked" portion 14*c* adjacent a second, or upper end.

The sleeve 14 also includes a peripheral portion having a plurality of flats or facets 14*d* that together create corners 14*e*. Specifically, each pair of adjacent facets 14*d* meet and form a corner 14*e* along the first or lower end of the sleeve 14. Preferably, at least five facets 14*d* are provided, which thus creates five corners 14*e*. In the most preferred embodiment, six facets 14*d* are provided, thus giving this portion of the sleeve 14 a generally hexagonal cross section (FIGS. 2*b* and 2*c*). However, it is possible to provide more or fewer facets 14*d*, which would thus result in a corresponding change in the cross section (e.g., three facets would make a triangle, four facets would make a square, eight facets would make an octagon, etc.).

FIGS. 2*b* and 2*c* illustrate that, when the sleeve 14 is provided with a cross section forming a regular polygon, the distance $D_1$ from any two opposed facets 14*d* is preferably smaller than the diameter M of the borehole H into which the sleeve 14 is to be inserted. However, the distance $D_2$ from opposed corners 14*e* is preferably at least equal to or slightly greater than the diameter of the borehole H. As will be better understood upon reviewing the description that follows, these corners 14*e* when so spaced apart provide the sleeve 14 with an oversized lower portion that helps the bolt 10 to resist rotation once placed in the borehole H and during subsequent tensioning.

Figure 3:
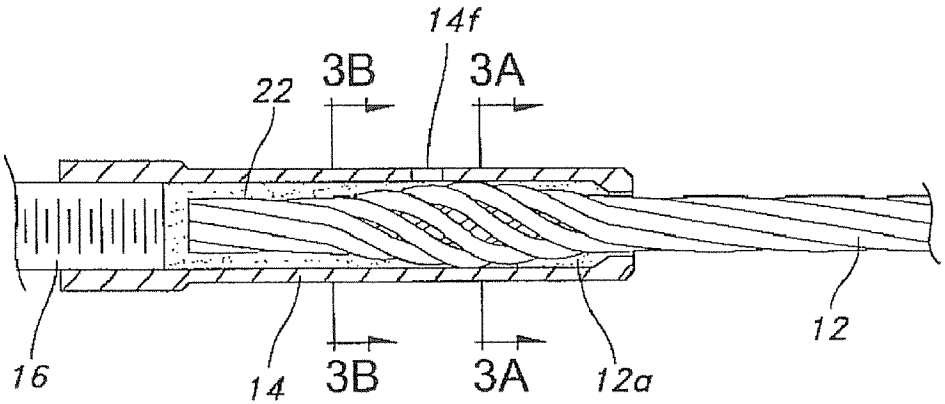
Figure 3B:
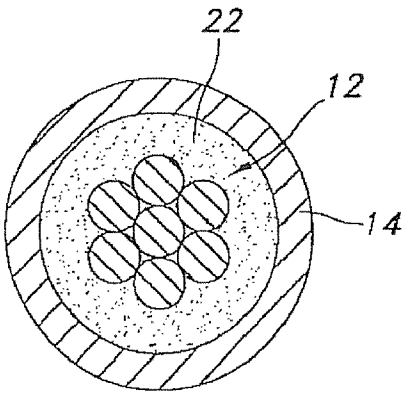
Figure 3A:
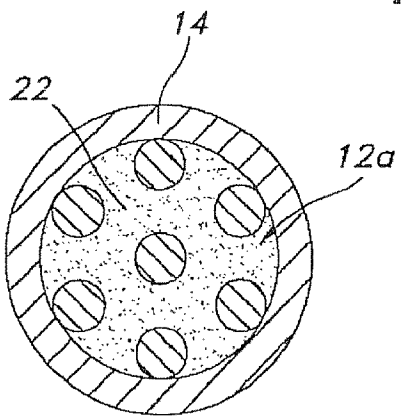

Turning now to FIGS. 3*a*-3*c*, one manner of connecting the cable 12 to the sleeve 14 in accordance with a preferred embodiment is disclosed. The sleeve 14 is passed over the cable 12 until an enlarged or oversized portion (e.g., bulb 12*a*) along the proximal end is received in the bore 14*b* (and preferably snugged into engagement with the undersized or necked portion 14*c*, which has a diameter that is less than the oversized portion of the cable 12). A threaded shank 16 may then be associated with the open end of the bore 14*b*, with the opposite open end of the bore being substantially closed off by the presence of the cable 12.

With the cable 12 in this position, resin 22 is injected from a source into the portion of the bore 14*b* including the oversized portion of the cable 12, or bulb 12*a* in the illustrated embodiment. Preferably, the resin 22 is injected through a transverse passage or channel 14*f* in the sleeve 14 and communicating with the bore 14*b* (see FIG. 2 also). However, it is also possible to supply the resin 22 though the open end of the bore 14*b* before the threaded shank 16 is inserted.

The resin 22 used to connect the cable 12 to the sleeve 14 may be of the two component variety, including a polyester component and a catalyst paste that, upon mixing, cure and harden in a matter of seconds (and sometimes called "grout" in the vernacular). The resin 22 used for this purpose may thus be similar or identical to that used to anchor the cable 12, but preferably has a higher viscosity to ensure that it remains within the bore 14*b* once injected. A suitable resin for this purpose is available from Minova International Ltd.

Regardless of the precise type of resin used or manner of injection, and as perhaps best understood by viewing FIGS. 3*b* and 3*c*, the resin 22 surrounds the cable 12. Specifically, the resin 22 penetrates into the bulb 12*a*, if present, surrounding each individual wire (see cross-section of FIG. 3*b*) and associates with any internal threads within the adjacent portion of the bore 14*b*. Upon curing and hardening, the resin 22 thus serves to form a cement-like bond that not only connects the cable 12 to the sleeve 14 in a most reliable and secure fashion, but also resists any relative rotation. Although the threaded shank 16 cannot be advanced within the bore 14*b* as a result of the presence of resin 22, this shank can be removed and replaced in a non-destructive fashion, if necessary or desired.

Figure 4:
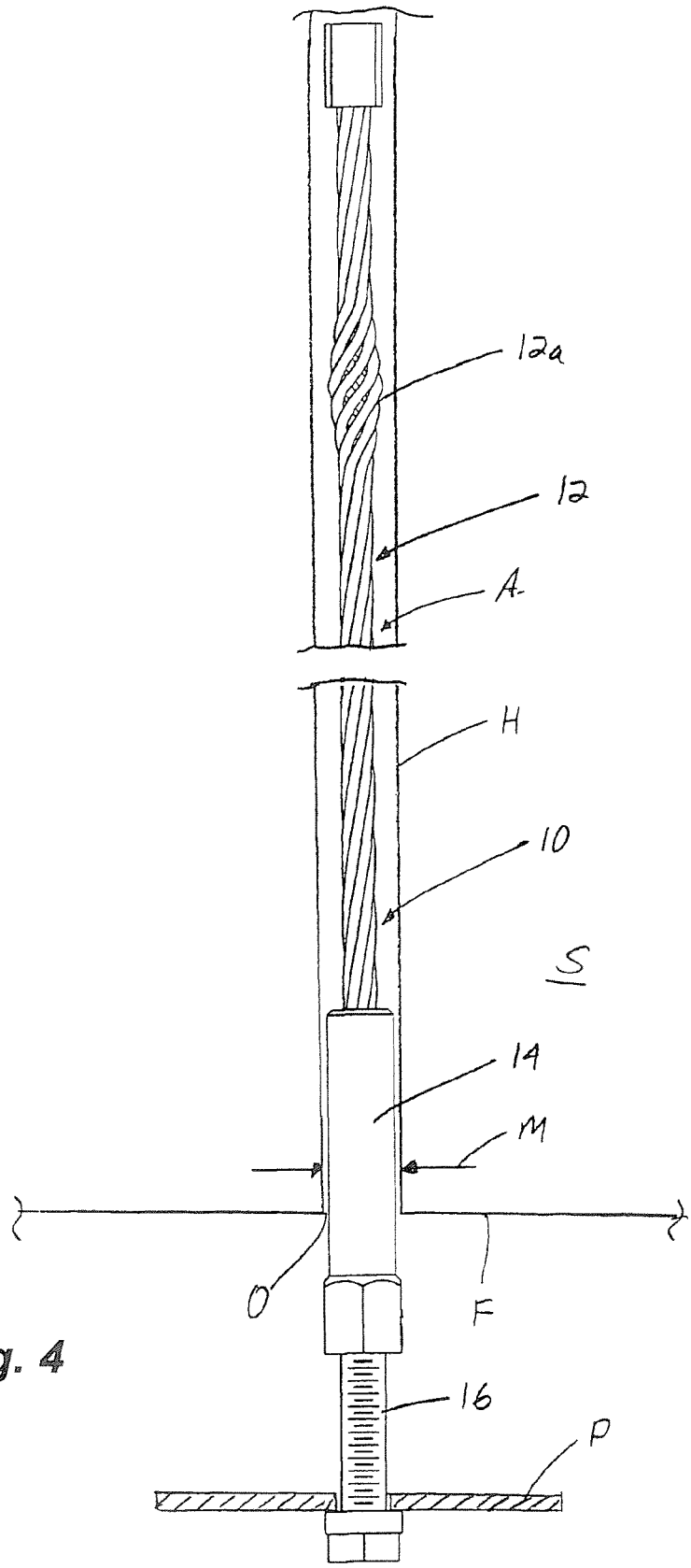
FIG. 4 is a side schematic view of the cable bolt apparatus partially inserted in a borehole in a mine passage.

Reference is now made to the progressive views of FIGS. 4-6 which although not drawn to scale, illustrate schematically the manner in which the bolt 10 of FIG. 1 is installed in the borehole H. Specifically, the distal end of the cable 12 is inserted through the opening O of the borehole H, which is preferably formed having a diameter M matching the distance $D_1$ across the plurality of facets 14*d* of the sleeve 14 (e.g., 1.375 inch distance $D_1$ for a 1.375 inch diameter borehole, which thus makes the opposed corner-to-corner distance $D_2$ about 1.6 inches). The borehole H also preferably has a depth slightly greater than the bolt 10, such as by at least one inch and possibly more.

Using a lift boom associated with a bolting machine (not shown) or like structure, the bolt 10 with the cable 12 is advanced into the borehole H such that at least the lower end of the sleeve 14 remains spaced from the adjacent face F and the portion including the facets 14*d* does not yet enter the opening O. Although FIG. 4 shows the sleeve 14 partially inserted within the borehole H, the entire sleeve 14 may initially remain outside of the borehole H while the cable 12 is advanced. The advancing is preferably done in a relatively slow, controlled fashion in an effort to prevent the cable 12 from binding or hanging within the borehole H.

Once the bolt 10 is partially inserted in this fashion, uncured resin or grout G is provided adjacent to at least a portion of the cable 12 in the associated annulus A (see FIGS. 5 and 6). Most preferably, the uncured resin or grout G is provided such that it occupies at least the annulus A adjacent the tail or distal end of the bolt 10, and in the upper portion of the borehole H. Although this uncured resin may be provided from a remote source, such as by way of injection, it is most preferably supplied in the form of a frangible cartridge (not shown), or resin "sausage" in the vernacular.

If this type of cartridge is used, it is normally pre-installed in the borehole H and ruptured during insertion of the cable 12, thus causing a quick-curing resin to occupy the surrounding borehole H. This grout G or resin also usually comprises two materials (e.g., polyester resin and a catalyst) that make contact and react only upon the rupturing of the cartridge. Upon being thoroughly mixed, such as by the rotation of the cable 12 within the borehole H (with any associated structures providing a mixing-assist function), the resin or grout G then quickly hardens. The hardened product thus serves to hold the cable 12 securely within the borehole H, and enables the resulting bolt 10 to undergo tensioning and resist movement in the longitudinal direction.

After mixing, but before the resin or grout G completely hardens (which, again, may take only a matter of seconds depending on the particular composition used), the bolt 10 is further advanced into the borehole H (FIG. 5), such as by using the lift boom of the associated bolter. This causes the corners 14*e* forming the oversized portion of the sleeve 14 to engage the adjacent strata S (FIG. 5*a*) and essentially form grooves in it. As a result of these corners 14*e* and the associated facets 14*d*, the bolt 10 securely and reliably resists rotation within the borehole H, and also creates a substantial seal such that the resin or grout G cannot leak out and come into contact with the threaded shank 16 (including any portion within the borehole). Once the resin sets or cures (which normally takes only seconds after mixing is complete), the bolt 10 is thus held securely within the borehole H and against movement in the axial or longitudinal direction as well.

The bolt 10 then undergoes tensioning to cause a plate P to engage the face F and compress the strata (FIG. 6). In the illustrated embodiment, this tensioning involves rotating and thus advancing a tension nut 18 associated with the threaded shank 16. This operation may be completed until any associated engagement hardware, such as a plate P, comes into secure engagement with the face F (which normally will take less than one complete turn). Applying the appropriate amount of torque (e.g., 250-275 ft/lb) ensures full tensioning of the bolt 10 as well as compression and anchoring of the strata in the desired manner.

Numerous advantages may thus arise from the use of the above-described bolt 10 and the associated installation technique. First of all, the ability of the cable bolt 10 when installed in this fashion to resist the undesirable twisting within the hole H eliminates the deleterious false tensioning and kick back prevalent with prior art arrangements. A more reliable installation thus results, with the installer knowing that the appropriate amount of tension has been applied to achieve the desired compression of the strata in accordance with the roof control plan.

Secondly, the combined use of a sleeve 14 entirely inserted into the borehole H and a separate threaded shank 16 eliminates the need for bulky castings or assemblies projecting from the mine face F, such as the roof line (see, e.g., U.S. Pat. Nos. 6,637,980 to Robertson, Jr. and 6,626,610 to Seegmiller). This can be especially important in situations where the overhead is small due to a relatively low seam height. The ability to remove the threaded shank 16 from the bore 14*b* formed in the lower end of the sleeve 14, including within the borehole H, is also considered desirable, since it allows for the bolt 10 to be retrofitted or customized for particular applications, and especially those in which a low profile is necessary or desired.

Thirdly, and perhaps most significantly, the bolt 10 is re-tensionable after the initial installation. Specifically, the threads of the shank 16 lie outside of the resin anchorage zone, and the sleeve 14 hinders the cable 12 from rotating or twisting during the application of torque to the nut 18. Accordingly, tension can be re-applied weeks, months, or even years after the initial installation. This is a significant advantage, especially if the plate P is inadvertently hit, there is subsequent shrinkage or shifting in the strata, or some of the roof immediately breaks away.

Besides the enlarged or oversized portion within the sleeve 14, it should be appreciated from FIG. 1 that other enlarged portions may be provided along the entire length of the cable 12. This may be accomplished in any known manner, including those described in the above-referenced '256 and '657 patents. Most preferably, any enlargement is done after the cable 12 is coupled to the sleeve 14 in the manner described.

The foregoing description of embodiments of the present invention has been presented for purposes of illustration and description. It is not intended to be exhaustive or to limit the invention to the precise form disclosed. Obvious modifications or variations are possible in light of the above teachings. For instance, although the use of resin 22 for securing or connecting the cable 12 to the sleeve 14 is preferred, a swaged or threaded union could instead be used, as could matching frusto-conical surfaces (such as on a collar attached to the cable 12 and along the bore 14*b* formed in the sleeve 14). The present embodiments were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention.

The invention claimed is:

1. An apparatus for installation in a borehole formed in a stratum creating a face of a mine passage in association with a cable, comprising:

an elongated sleeve for receiving and securing one end of the cable, said sleeve having a lower end including an internally threaded bore for receiving a threaded shank and a plurality of facets along a peripheral portion forming corners adapted for engaging the stratum within the borehole during installation of the lower end in the borehole.

2. The apparatus of claim 1, wherein the bore extends entirely through the sleeve and includes an undersized portion for engaging an oversized portion of the cable.

3. The apparatus of claim 2, further including resin within the bore for connecting the cable to the sleeve.

4. The apparatus of claim 3, wherein the sleeve includes a transverse channel for injecting the resin into the bore.

5. The apparatus of claim 1, wherein the plurality of facets are arranged to provide the peripheral portion with a cross section forming a regular polygon.

6. The apparatus of claim 1, wherein at least two of the corners are spaced apart a distance greater than a diameter of the borehole.

7. An apparatus for installation in a borehole having a diameter formed in a face of a mine passage, comprising:

an elongated cable for extending into the borehole, said cable having an oversized portion; and a sleeve having a bore for receiving the oversized portion of the cable and resin located within the sleeve for securing the cable to the sleeve.

8. The apparatus of claim 7, wherein a peripheral portion of the sleeve includes a plurality of facets.

9. The apparatus of claim 8, wherein the facets provide the peripheral portion of the sleeve with a cross-section forming a regular polygon.

10. The apparatus of claim 7, wherein the bore includes an internally threaded portion for receiving a threaded shank carrying a tension nut.

11. The apparatus of claim 7, wherein the resin holds the oversized portion of the cable within the bore.

12. A method of forming a bolting apparatus for insertion in a borehole formed in a mine passage, comprising:

inserting an oversized portion of a cable into a bore of a sleeve; and securing the oversized portion of the cable within the sleeve, including by using resin located within the sleeve;

whereby the resin when cured or hardened securely holds the oversized portion of the cable within the sleeve during tensioning.

13. The method of claim 12, further including the step of snugging the oversized portion of the cable against an undersized portion of the bore.

14. The method of claim 12, wherein the securing step comprises injecting the resin comprising a two-component resin into the bore adjacent the oversized portion of the cable.

15. The method of claim 12, further including the step of inserting a threaded shank into the sleeve.

16. A method of installing a cable bolt in a borehole formed in a mine passage, comprising:

securing a cable to a sleeve having an oversized portion relative to the borehole wherein the diameter of the sleeve is greater than the diameter of the borehole wall;

securing the cable and the sleeve within the borehole with the oversized portion in engagement with an adjacent strata; and inserting a threaded shank into an internal bore formed in the sleeve.

17. The method of claim 16, further including the step of tensioning the bolt by advancing a tension nut along the threaded shank.

18. The method of claim 16, wherein the oversized portion of the sleeve includes a plurality of facets creating corners, and the securing step includes inserting the oversized portion of the sleeve within the borehole.

19. The method of claim 16, wherein the securing step includes grouting the cable in the borehole.

20. The method of claim 16, wherein the securing step comprises using grout or resin to secure the oversized portion of the cable to the sleeve.

* * * * *